US008936093B2

(12) United States Patent
Smith

(10) Patent No.: US 8,936,093 B2
(45) **Date of Patent: *Jan. 20, 2015**

(54) CONTROLLED RISE VELOCITY BOUYANT BALL ASSISTED HYDROCARBON LIFT SYSTEM AND METHOD

(71) Applicant: Rodney D. Smith, North Ogden, UT (US)

(72) Inventor: Rodney D. Smith, North Ogden, UT (US)

(73) Assignee: Smithsonian Energy, Inc., Sandy, UT (US)

( * ) Notice: Subject to any disclaimer, the term of this patent is extended or adjusted under 35 U.S.C. 154(b) by 39 days.

This patent is subject to a terminal disclaimer.

(21) Appl. No.: 14/085,600

(22) Filed: Nov. 20, 2013

(65) Prior Publication Data

US 2014/0311731 A1 Oct. 23, 2014

Related U.S. Application Data

(63) Continuation-in-part of application No. 13/706,150, filed on Dec. 5, 2012, which is a continuation-in-part of application No. 13/568,471, filed on Aug. 7, 2012, now Pat. No. 8,430,172.

(51) Int. Cl.
*E21B 43/16* (2006.01)

(52) U.S. Cl.
USPC ..... 166/372; 166/305.1

(58) Field of Classification Search
USPC ..... 166/372, 305.1
See application file for complete search history.

(56) References Cited

U.S. PATENT DOCUMENTS 6,530,437 B2 3/2003 Maurer et al.

*Primary Examiner* — Catherine Loikith
(74) *Attorney, Agent, or Firm* — Lyman Moulton, Esq.; Moulton Patents, PLLC

(57) ABSTRACT

A hydrocarbon lift system and method for increasing petroleum production from an enclosed subterranean reservoir to the earth's surface comprises a column of buoyant balls in an outer pipe configured to entrain the buoyant balls into a first fluid in an annulus formed with an inner pipe drill string. A pressure differential in the inner pipe with respect to the reservoir via the entrained buoyant balls in a second fluid therein lifts the second fluid and the entrained balls via the inner pipe to increase petroleum production to the to earth's surface. A controlled rise velocity of the buoyant balls and the second fluid is predetermined by a ratio of a mass density of the buoyant balls to a mass density of the second fluid being greater than a mass density of the buoyant balls to a mass density of the first fluid for an increase over time in oil production.

19 Claims, 8 Drawing Sheets

CONTROLLED RISE VELOCITY BOUYANT BALL ASSISTED HYDROCARBON LIFT SYSTEM AND METHOD

CROSS-REFERENCE TO RELATED APPLICATIONS

This application is a continuation-in-part of and claims the benefit of the priority date of earlier filed U.S. Non-Provisional Utility application Ser. No. 13/706,150, filed Dec. 5, 2012 for Rod D. Smith, which claims the benefit of earlier filed U.S. Non-Provisional patent application Ser. No. 13/568,471, now U.S. Pat. No. 8,430,172 filed Aug. 7, 2012 for Rod D. Smith et al. which claims the benefit of earlier filed U.S. Provisional Patent Application Ser. No. 61/659,394, filed Jun. 13, 2012 for Rod D. Smith, each incorporated herein by reference in its entirety.

BACKGROUND AND FIELD OF INVENTION

By some measures, a total of about 707,000 barrels of oil per day were produced in the United States in 1998 using Enhanced Oil Recovery (EOR) methods, accounting for about 12% of total national crude oil production. Methods vary including thermal (steam and hot water), gas (carbon dioxide, nitrogen), chemical and even microbial enhanced oil production. The carbon dioxide, natural gas and nitrogen EOR consume much more electric power per barrel of oil produced than thermal EOR methods. Current electric power requirements for gas EOR for pumping fluids from the wells (including substantial amounts of water), separating product etc consumes an estimated 1.5 million hp (1,230 MW). Therefore, opportunities are plentiful for business development for petroleum producers and utilities to come up with more effective and less expensive methods of EOR.

Subterranean wells may be drilled primarily to extract fluids such as water, hydrocarbon liquids and hydrocarbon gases. These fluids exist within the earth to depths in excess of 5000 meters below the earth's surface. Subterranean traps, called reservoirs, accumulate the fluids in sufficient quantities to make their recovery economically viable. Whether or not a fluid of interest can reach the earth's surface without aid may be a function of the potential energy of the fluid in the reservoir, reservoir driver mechanisms, reservoir rock characteristics, near wellbore rock characteristics, physical properties of the desired fluid and associated fluids, depth of the reservoir, wellbore configuration, operating conditions of the surface facilities receiving fluids and the stage of the reservoir's depletion.

Many wells in the early stages of production are capable of producing fluids with little more than a pipe to connect the reservoir with surface facilities, as energy from the reservoir and changing fluid characteristics can lift to desired fluids to the surface. However, to improve the economics of a well, it may be necessary to increase the production rate and maximize the recovery of the desired fluid(s) from the well. Transportation of fluids from the reservoir to the surface, that is well bore dynamics, is one of the variables of the well that can be controlled and has a major impact on the economics of a well.

One can improve well bore dynamics by two methods: 1) designing a wellbore configuration that optimizes and improves the flow characteristics of the fluid in the well bore conduit, and/or 2) aiding in lifting the fluid to surface with artificial lift. Artificial lift can significantly improve production early in life of many wells and may be the only option for wells operating in the later stages of depletion. There are numerous systems of artificial lift available and operating throughout the world. The more common systems are reciprocating rod string and plunger pumps, rotating rod strings and progressive cavity pumps, electric submersible multistage centrifugal pump, jet pumps, hydraulic pumps and gas lift systems. To fit in the category of artificial lift, additional energy not from the producing formation or fluids input into the well bore is added to help lift fluids in the liquid paths to the earth's surface. With the depletion of the world's fluid reserves, there is a long felt need to develop an artificial lift system and method that is both economical and practical.

SUMMARY OF THE INVENTION

A buoyant ball assisted hydrostatic lift system and method lifts a fluid from an enclosed subterranean reservoir to the earth's surface. The disclosed system also includes a pipe string configured at a steady state gas pressure with any quiescent gas escape offset by an equal gas input. The system also includes a plurality of buoyant balls in the pipe string; the balls configured to at least one of displace a fluid mass and have a surface friction moving in a fluid therein. The system additionally includes a column of the buoyant balls in the pipe string, an aggregate weight of the balls in the column configured to entrain the balls into a fluid in an annulus formed with an outer bore pipe. The system further includes a hydrostatic pressure differential in the annulus with respect to the reservoir via the buoyant balls, the pressure configured to lift the entraining fluid and the entrained to balls in the annulus to the surface.

An embodiment of the disclosed system enhances petroleum production via a column of buoyant balls entrained in a pressurized fluid in the pipe string, the entrained buoyant balls are configured to enable a pressure differential in the annulus with respect to the pressure in the reservoir and lift the entrainment via the annulus to the earth's surface. The embodied system may also be configured to vice versa entrain the column of buoyant balls in a pressurized fluid in the annulus, the entrained buoyant balls configured to enable a pressure differential in the pipe string with respect to the pressure in the reservoir and lift the entrainment via the pipe string to the earth's surface.

The disclosed method includes providing a pipe string configured at a steady state gas pressure with a quiescent gas escape offset by an equal gas input. The method also includes providing a plurality of buoyant balls in the pipe string; the balls configured to at least one of displace a fluid mass and have a surface friction moving in a fluid therein. The method additionally includes providing a column of the buoyant balls in the pipe string, an aggregate weight of the balls in the column configured to entrain the balls into a fluid in an annulus formed with an outer bore pipe. The method further includes creating a hydrostatic pressure differential in the annulus with respect to the reservoir via the buoyant balls, the pressure configured to lift a fluid in the annulus to the surface. The disclosed method yet includes recovering the buoyant balls from the fluid lifted to the surface in a recovery reservoir at atmospheric pressure.

A hydrocarbon lift system for lifting petroleum fluid(s) from an enclosed subterranean reservoir to the earth's surface, the system comprises a column of a plurality of buoyant balls in an outer pipe configured to entrain the buoyant balls into a first fluid in an annulus formed with an inner pipe drill string; a pressure differential in the inner pipe drill string with respect to the reservoir via the entrained buoyant balls in a second fluid therein, the pressure differential configured to lift the second fluid and the entrained balls via the inner pipe drill string to enhance petroleum production to the surface; and a controlled rise velocity of the buoyant balls and the second fluid determined by a ratio of a mass density of the buoyant balls to a mass density of the second fluid greater than a mass density of the buoyant balls to a mass density of the first fluid.

Other aspects and advantages of embodiments of the disclosure will become apparent from the following detailed description, taken in conjunction with the accompanying drawings, illustrated by way of example of the principles of the disclosure.

Figure 1:
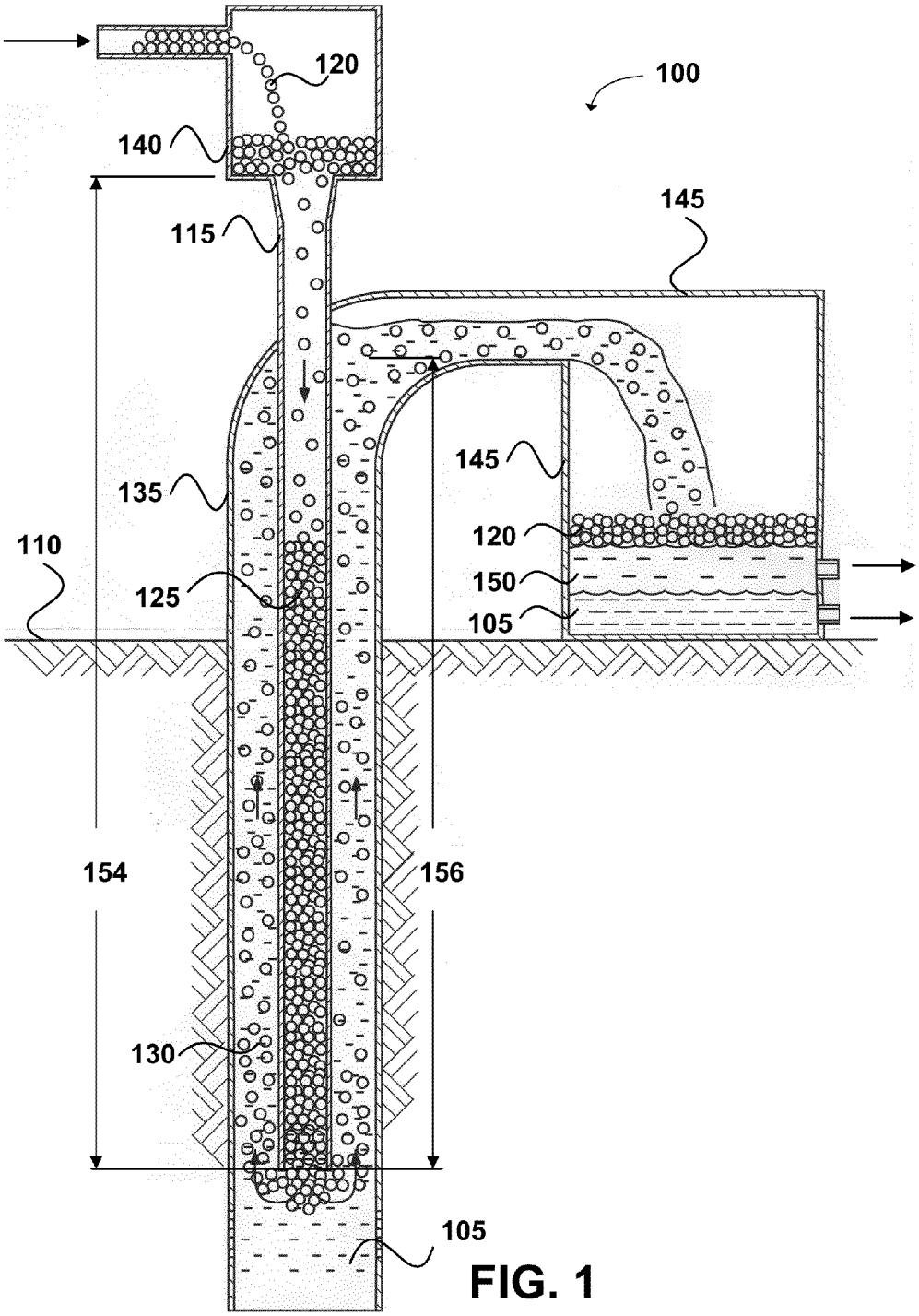
FIG. 1 is a cross sectional view of a buoyant ball assisted hydrostatic lift system comprising a static pressurized column of buoyant balls in accordance with an embodiment of the present disclosure.

Throughout the description, similar and same reference numbers may be used to identify similar and same elements depicted in multiple embodiments. Although specific embodiments of the invention have been described and to illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

Present best known methods may include artificial lift via a high pressure source at the surface of a well to inject gas down an annulus and into a tubing bore. The compressed gas may be injected into the product stream through valves and may create an aeration or bubbling effect in the liquid column. The gas bubbles may expand as they rise to the surface, displacing liquid around them. This may decrease the density and weight of the fluid and create a differential pressure between the reservoir and the well bore and allow the well to produce at its optimum rate. However, the recovery and necessary recompression of gases used for lifting is expensive and cumbersome. There is a long felt need in the market of hydrostatic artificial lift systems for a system and method that is both economical and practical without the expensive use of gases.

The term 'pipe string' as used throughout the present disclosure defines a column or string of pipe that transmits the lifting and/or drilling mechanisms and is therefore interchangeable with the term 'drill string' also commonly used in the art. The term 'annulus' used throughout the disclosure defines a ring of space between a well bore inner wall and a pipe string outer wall where the pipe string is positioned within the well bore. The term 'fluid' as used throughout the present disclosure defines both a gas and a liquid. The term 'ball' to as used throughout the present disclosure may refer to circular, semi-circular, spherical and other geometrical bead-like or bubble-like devices having rigid or semi-rigid walls and various sizes, shapes, porosities, specific gravities and various configurations including dimples, cavities (external and internal), recesses and the like. The term 'entrainment' may include both an entraining fluid and the buoyant objects entrained therein. Also the terms 'specific gravity' and 'mass density' are relational through the mass of a fluid in relation to water. The term 'rise velocity' may refer to vertical and/or helical and/or horizontal velocity as a ball or sphere is rising in a fluid even though the ball or sphere may take a zigzag-like path there through. Therefore, the 'rise velocity' may be a velocity of the ball or sphere with a vertical spatial component opposing gravity relative to the fluid surrounding it rather than relative to the reservoir and/or the pipe thereof.

The purpose of the disclosed apparatus, system and method is to improve the volume of discharged fluids flowing from a well bore. In the alternative, if the well is within equilibrium and can no longer naturally flow, the disclosed process may initiate natural flow again. This is accomplished by changing the hydrostatic pressure within a fluid column through a mechanism of displacing fluid mass with buoyant balls sharing the space within the casing in a flowing well. This reduction in hydrostatic pressure may increase the net amount of fluids flowing in a given increment of time.

One embodiment of the disclosure takes advantage of the down pipe that is normally used to contain the flow of fluids to the surface and uses it as a conduit to transfer the buoyant balls down the bore hole to a desired depth. To facilitate the process of getting the balls to the bottom of the pipe, gas pressure is used to push down the water table in this center pipe (aka pipe string) to varying depths forming a gas column. As an example, at approximately a 5,000 foot level, if the water table ascended from the reservoir to the top (or the surface) of that pipe, and if there was no more natural reservoir pressure to push the liquid beyond the surface, it may take approximately (depending on the specific gravity of the liquid) 2200 psi of gas pressure to push the water table that was at the surface all the way down the pipe to the 5,000 foot predetermined level.

In an embodiment of the disclosure, the gas does not exit the bottom of pipe string, but instead, only enough pressure is administered to take the water table down to a very short distance from the end of the pipe. This creates a hollow void of steady state gas pressure occupying the internal volume of the pipe all the way back up to the surface. In contrast, the annulus between the pipe string and the well bore could be full of liquid from the reservoir to any point, all the way up to the surface.

Embodiments of the disclosure include small buoyant balls fed into the pipe string. Under the force of gravity, the balls may fall all the way down to the water table 5,000 feet below. Since the balls are buoyant, they may float on the water table at the bottom of the pipe. As the accumulated amount of buoyant balls land on top of each other, the aggregated weight will eventually push the lower balls down into the liquid until they reach the end of the pipe and start their ascension up the annulus entrained in the fluid(s) of the reservoir.

As the volume of balls increase in the annulus, the hydrostatic pressure housed in the annulus may start decreasing. The resisting force that the column is putting on the reservoir starts to lower and the spread between the reservoir's pressure and the column resisting hydrostatic pressure gets wider. This increase in differential pressure may allow the well to start flowing again, or increase the volume of a well that is currently flowing. The annulus may thus be used to discharge the flow coming to the surface verses the concentric pipe that is conventionally used as a gas column. A disclosed mechanism gathers these buoyant balls at the surface and puts them in an apparatus that allows them to overcome the pressure required to reenter the gas column described earlier.

FIG. 1 is a cross sectional view of a buoyant ball assisted hydrostatic lift system comprising a static pressurized column of buoyant balls in accordance with an embodiment of the present disclosure. The disclosed buoyant ball assisted hydrostatic lift system 100 lifts a fluid 105 from an enclosed subterranean reservoir to the earth's surface 110. The disclosed system 100 includes a pipe string 115 configured at a steady state gas pressure with any quiescent gas escape offset by an equal gas input. The system also includes a plurality of buoyant balls 120 in the pipe string 115, the balls configured to at least one of displace a fluid mass 105 and have a surface friction moving in a fluid 105 therein. The surface friction may come from a design and/or a type of covering on the buoyant ball's surface as disclosed herein. Materials and designs having larger surface friction may increase the hydrostatic pressure differential as discussed herein. Conversely, materials and designs having less surface friction may decrease the hydrostatic pressure differential. Any design increasing the surface area of a buoyant ball may increase its surface friction and therefore increase the pressure differential in the annulus or vice versa in the pipe string. The pressure differential (pressure loss) may result from a heating the fluid(s) due to the surface friction of the entrained balls causing a net loss of energy in the enclosed system including the present disclosure and the well thereof. The system 100 additionally includes a column 125 of the buoyant balls 120 in the pipe string 115, an aggregate weight of the balls 120 in the column 125 configured to entrain the balls 120 into a fluid 105 in an annulus 130 formed with an outer bore pipe 135. The system further includes a hydrostatic pressure differential lifting the entrained balls in the annulus 130 with respect to the reservoir via the buoyant balls 120, the pressure differential configured to lift the fluid 105 in the annulus 130 to the surface 110. A ball reservoir 140 and a recovery reservoir 145 are also depicted. Water 150 may be present in the reservoir and lifted into the recovery reservoir 145 via the disclosed system and method.

A vice versa embodiment of the disclosed hydrostatic lift system wherein the steady state gas pressure and the column of buoyant balls are vice versa disposed in the annulus and an entrainment comprising the entraining fluid and the entrained buoyant balls is vice versa disposed in the pipe string, enables a hydrostatic pressure differential in the pipe string to lift the entrainment to the earth's surface via the pipe string. The embodiment includes an annulus pipe string configured at a steady state gas pressure with any quiescent gas escape offset by an equal gas input. The system also includes a plurality of buoyant balls in the annulus; the balls configured to at least one of displace a fluid mass and have a surface friction moving in a fluid therein. The system additionally includes a column of the buoyant balls in the annulus, an aggregate weight of the balls in the column configured to entrain the balls into a fluid in a pipe string positioned within an outer bore pipe. The system further includes a hydrostatic pressure differential in the pipe string with respect to the reservoir via the buoyant balls, the pressure configured to lift a fluid in the pipe string to the surface.

Another embodiment of the disclosed hydrostatic lift system includes to buoyant balls 120 of a specific gravity less than a ratio of 1 in relation to the specific gravity of a fluid in the annulus 130. Also, the steady state gas pressure in the pipe string 115 forces a water table in the pipe string 115 submerged in the reservoir below the surface 110 and proximal to a bottom end of the pipe string submerged in the reservoir. Additionally, the column of buoyant balls 125 forms under an aggregate weight of the buoyant balls 120 and extends from a bottom end of the pipe string 115 to a column height 154 greater than a height of the fluid 156 in the string pipe 115 and the annulus 130. In other words, a product of the ball density with the height of ball column 154 and gravity may be greater than a product of the fluid density with the height of fluid 156 and gravity. Ball density may be less than fluid density and gravity cancels out so the height of the column may be greater than the height of the fluid (Hc>>Hf). Embodiments include various column heights where balls of greater density and weight allow shorter columns able to entrain the balls in the fluid(s). Also, the hydrostatic pressure is a product of gravity acting on a fluid density of any fluids in the pipe string 115 and the annulus displaced by the aggregate volume of the buoyant balls 120 therein and the height of the fluids from a confluence of the balls in the fluids to an overflow of the annulus 130 at the surface 110 into a catch reservoir 145. The fluid in the disclosed system may comprise at least one of water and a petroleum fluid.

In an embodiment of the disclosed hydrostatic lift system, the surface friction of the buoyant balls 120 moving through the fluid(s) 105 creates a loss of hydrostatic pressure in the annulus 130 and creates a lift of the fluid(s) 105 at a greater hydrostatic pressure in the subterranean reservoir to the surface 110 through the annulus 130. From a conservation of energy perspective of the closed system 100, the loss of potential energy in the annulus 130 due to the friction of the balls 120 moving there through create a pressure loss which lifts the fluid(s) in the annulus.

Embodiments of the hydrostatic lift system may further include a reservoir 140 of the buoyant balls 120, the reservoir 140 disposed adjacent a top of the pipe string 115 proximal the surface 110, the reservoir 140 configured to provide buoyant balls 120 for the column 125 of the buoyant balls 120 in the pipe string 115 at the steady state gas pressure. Also, a catch reservoir 145 may be to disposed adjacent a top of the annulus 130 proximal the surface 110, the reservoir 145 configured to provide a catch for the lifted fluid(s) 105 and 150 and the buoyant balls 120. Additionally, a recovery hopper and a series of valves (depicted in FIG. 3-6) may be configured to separate the buoyant balls 120 from the fluid(s) 105 and 150 rising to the surface 110 into the catch reservoir 145 at atmospheric pressure.

Figure 2:
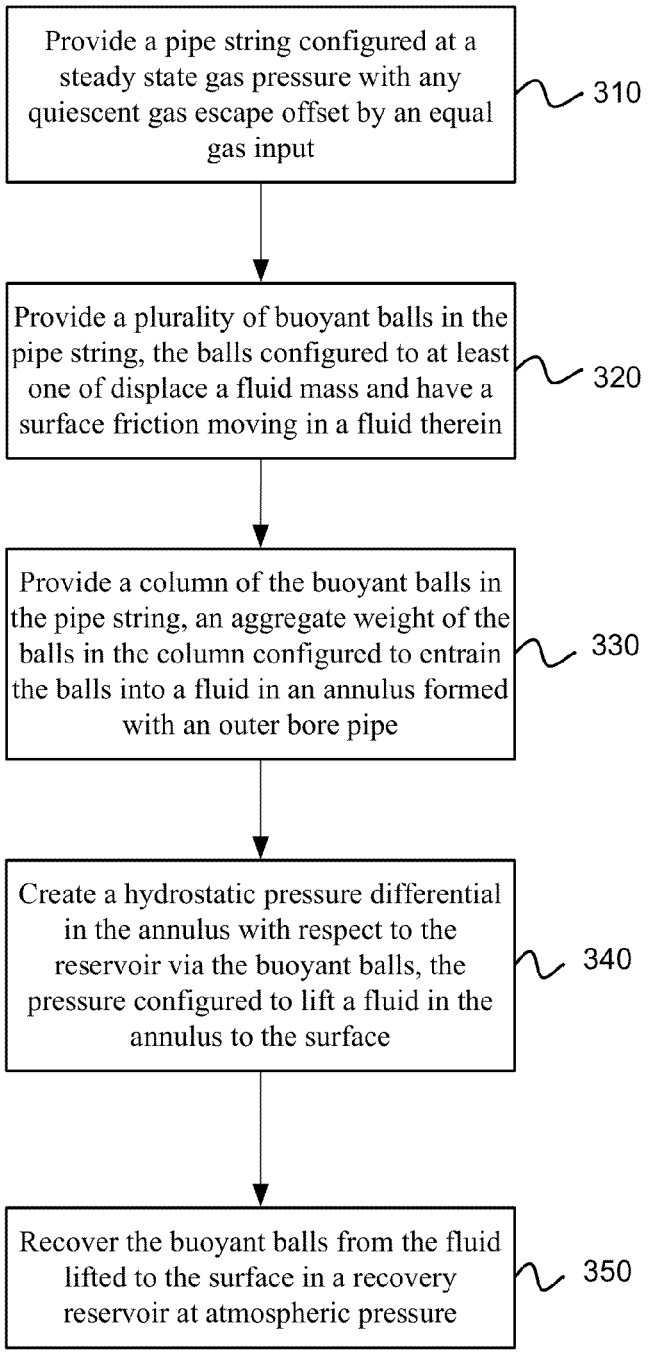
FIG. 2 is a block diagram of a method for buoyant ball assisted hydrostatic lift in accordance with an embodiment of the present disclosure.

FIG. 2 is a block diagram of a method for buoyant ball assisted hydrostatic lift in accordance with an embodiment of the present disclosure. The disclosed method includes providing 310 a pipe string configured at a steady state gas pressure with a quiescent gas escape offset by an equal gas input. The method also includes providing 320 a plurality of buoyant balls in the pipe string, the balls configured to at least one of displace a fluid mass and have a surface friction moving in a fluid therein. The method additionally includes providing 330 a column of the buoyant balls in the pipe string, an aggregate weight of the balls in the column configured to entrain the balls into a fluid in an annulus formed with an outer bore pipe. The method further includes creating 340 a hydrostatic pressure differential in the annulus with respect to the reservoir via the buoyant balls, the pressure configured to lift a fluid in the annulus to the surface. The disclosed method may yet include recovering 350 the buoyant balls from the fluid lifted to the surface in a recovery reservoir at atmospheric pressure.

An embodiment of the hydrostatic lift method includes forcing a water table in the pipe string submerged in the pipe string below the surface and proximal to a bottom end of the pipe string submerged in the reservoir via the steady state gas pressure. Also, the buoyant balls may provide an aggregate volume greater than a volume of the annulus. The buoyant balls may also form a column extending from a bottom end of the pipe string to a column height greater than a height of the fluid in the pipe string and the annulus. A height of the buoyant balls greater than a combined height of the pipe string and the annulus may be required for the balls to be entrained in the fluid(s) of the annulus. Also, a hydrostatic pressure differential created in the annulus with respect to the reservoir via the buoyant balls further comprises displacing a volume of fluids in the annulus and the pipe string from a bottom of the pipe string to an overflow of the annulus at the surface into a catch reservoir 145.

An embodiment of the hydrostatic lift method may further comprise providing a reservoir of the buoyant balls 140, the reservoir 140 disposed adjacent a top of the pipe string proximal the surface, the reservoir 140 configured to provide buoyant balls for the column of the buoyant balls in the pipe string at the steady state gas pressure. A catch reservoir 145 may be disposed adjacent a top of the annulus proximal the surface, the reservoir configured to provide a catch for the lifted fluid (s) and the buoyant balls. Recovering the buoyant balls from the fluid lifted to the surface in a recovery reservoir may comprise separating the buoyant balls from the fluid via a series of valves. Also, in order to reintroduce the buoyant balls into the column of buoyant balls in the pipe string, a ball reservoir may be disposed adjacent a top of the pipe string proximal the surface, the reservoir configured at the steady state gas pressure.

Figure 3:
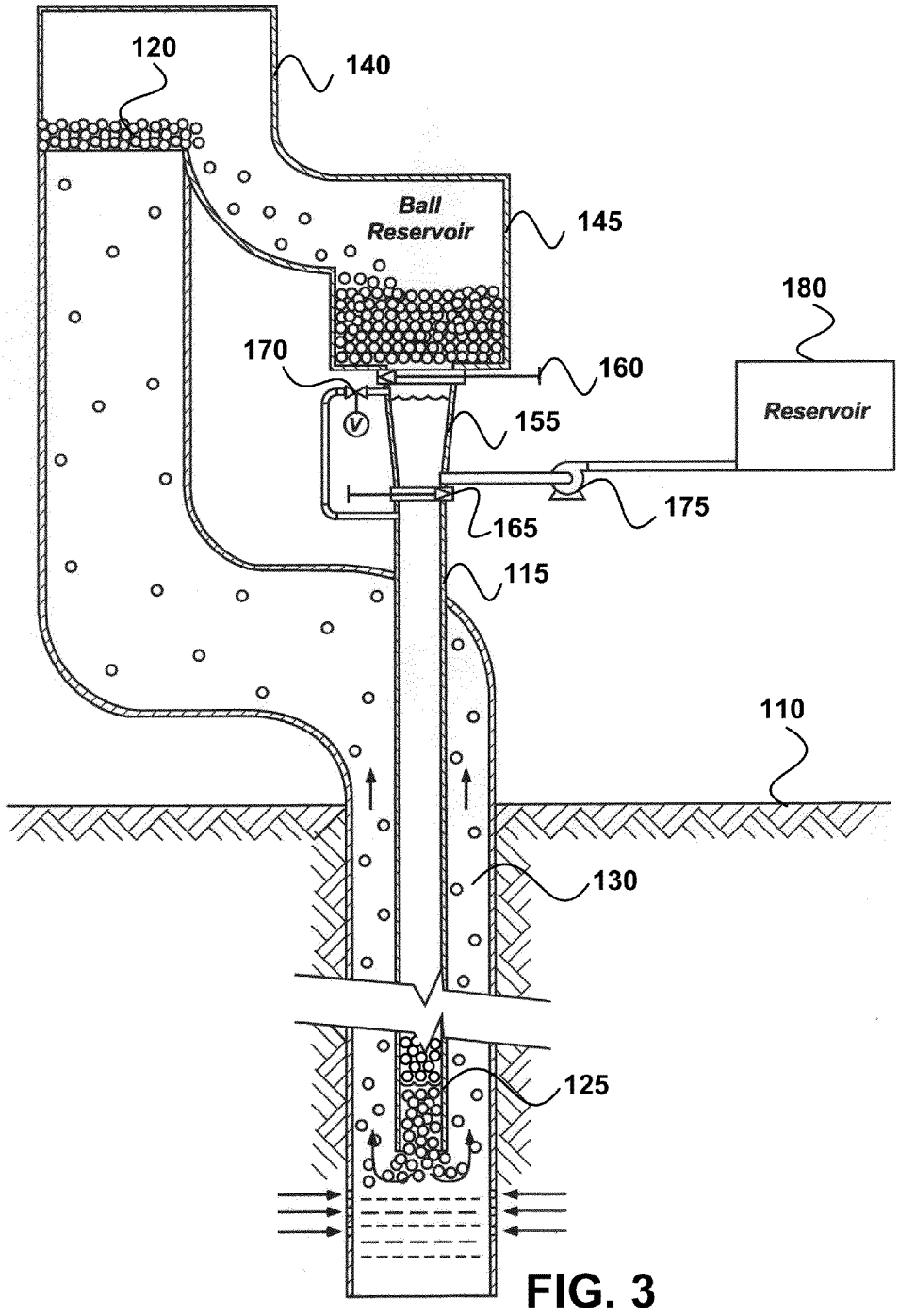
FIG. 3 is a cross sectional view of a buoyant ball recovery system in accordance with an embodiment of the present disclosure.

FIG. 3 is a cross sectional view of a buoyant ball recovery system in accordance with an embodiment of the present disclosure. The disclosed buoyant ball assisted hydrostatic lift system 100 lifts a fluid 105 and 150 from an enclosed subterranean reservoir to the earth's surface 110. The disclosed system 100 includes a pipe string 115 configured at a steady state gas pressure with any quiescent gas escape offset by an equal gas input. The system also includes a plurality of buoyant balls 120 in the pipe string 115, the balls configured to at least one of displace a fluid mass 105/150 and have a surface friction moving in the fluid(s) therein. The system 100 additionally includes a column 125 of the buoyant balls 120 in the pipe string 115, an aggregate weight of the balls 120 in the column 125 configured to entrain the balls 120 into a fluid 105/150 in an annulus 130 formed with an outer bore pipe 135. Embodiments of the present disclosure include various column heights where balls of greater density and weight allow shorter columns of balls in the pipe string able to entrain the balls in the fluid(s). The system further includes a hydrostatic pressure differential in the annulus 130 with respect to the reservoir via the buoyant balls 120, the pressure configured to lift the fluid 105 in the annulus 130 to the surface 110. A ball reservoir 140 and a recovery reservoir 145 are also depicted. Water 150 may be present in the reservoir and lifted into the recovery reservoir 145 via the disclosed system and method.

Further depicted in FIG. 3, a hopper 155 (aka hopper area) may be to disposed between the ball reservoir 145 and the pipe string 115. A valve 160 may be disposed on the top of the hopper 155 that separates the ball reservoir 145 from the hopper area and a valve 165 on the bottom of the hopper 155 separates the hopper 155 from the high pressure zone there below in the pipe string. These valves 160 and 165 open and close to allow the balls to enter the hopper area 155 and the pipe string 115. After a pressure differential is mitigated, the balls 120 fall into the high pressure zone as gravity acts upon them. Valves 160 and 165 are depicted as slide valves, however, there are many other valves that may be used in embodiments of the present disclosure.

Again referring to FIG. 3, the lower valve 165 is closed, the vent valve 170 is closed and the upper hopper valve 160 is also closed. Prior to the upper slide valve 160 opening, a high pressure pump 175 pumps fluid into the hopper chamber area from the reservoir 180. During the pumping sequence, the vent valve 170 is open to the high pressure zone. As the water table rises to the top of the hopper, the vent valve 170 to the high pressure zone is closed. The pump 175 is turned off and at that time the upper slide valve 160 opens. FIG. 3 highlights the hopper area full of fluid. The upper slide valve 160 is open to the ball reservoir above it. The vent valve to the high pressure zone is closed and the lower hopper slide valve 165 is closed.

Figure 4:
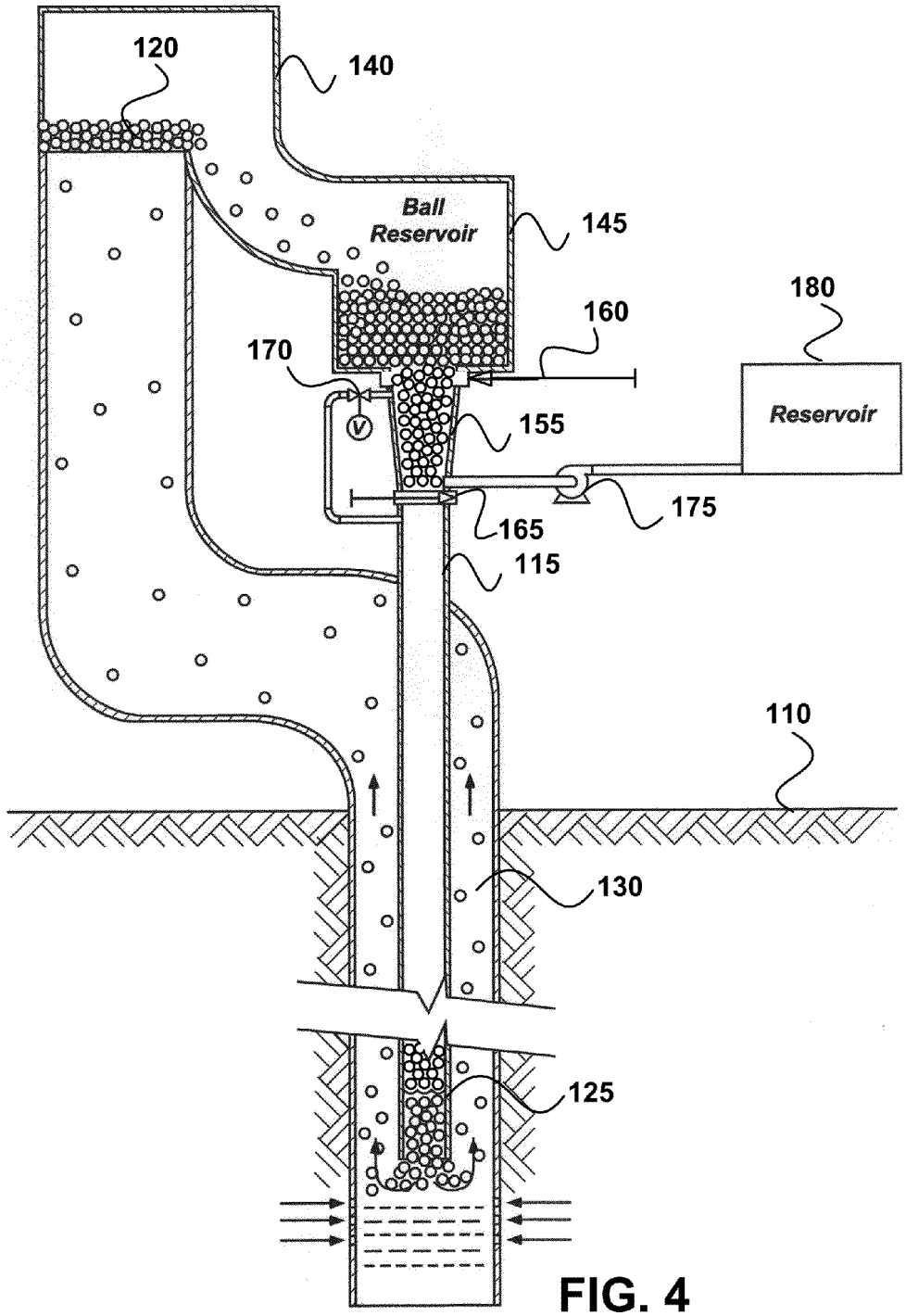
FIG. 4 is a cross sectional view of a buoyant ball recovery system where a ball hopper is vented in accordance with an embodiment of the present disclosure.

FIG. 4 is a cross sectional view of a buoyant ball recovery system where a ball hopper is vented in accordance with an embodiment of the present disclosure. Elements depicted are similar or the same as the elements depicted in FIG. 3. The lower slide valve 165 is closed. The upper slide valve 160 is open and the vent valve 170 is closed. The ball reservoir 145 is full of buoyant balls 120 that are now floating on top of the fluid level. At this point, the pump 175 is turned on and the fluid is pumped out of the hopper area 155. As the fluid is pumped out, the buoyant balls 120 float on the fluid and descend into the hopper area 155.

Figure 5:
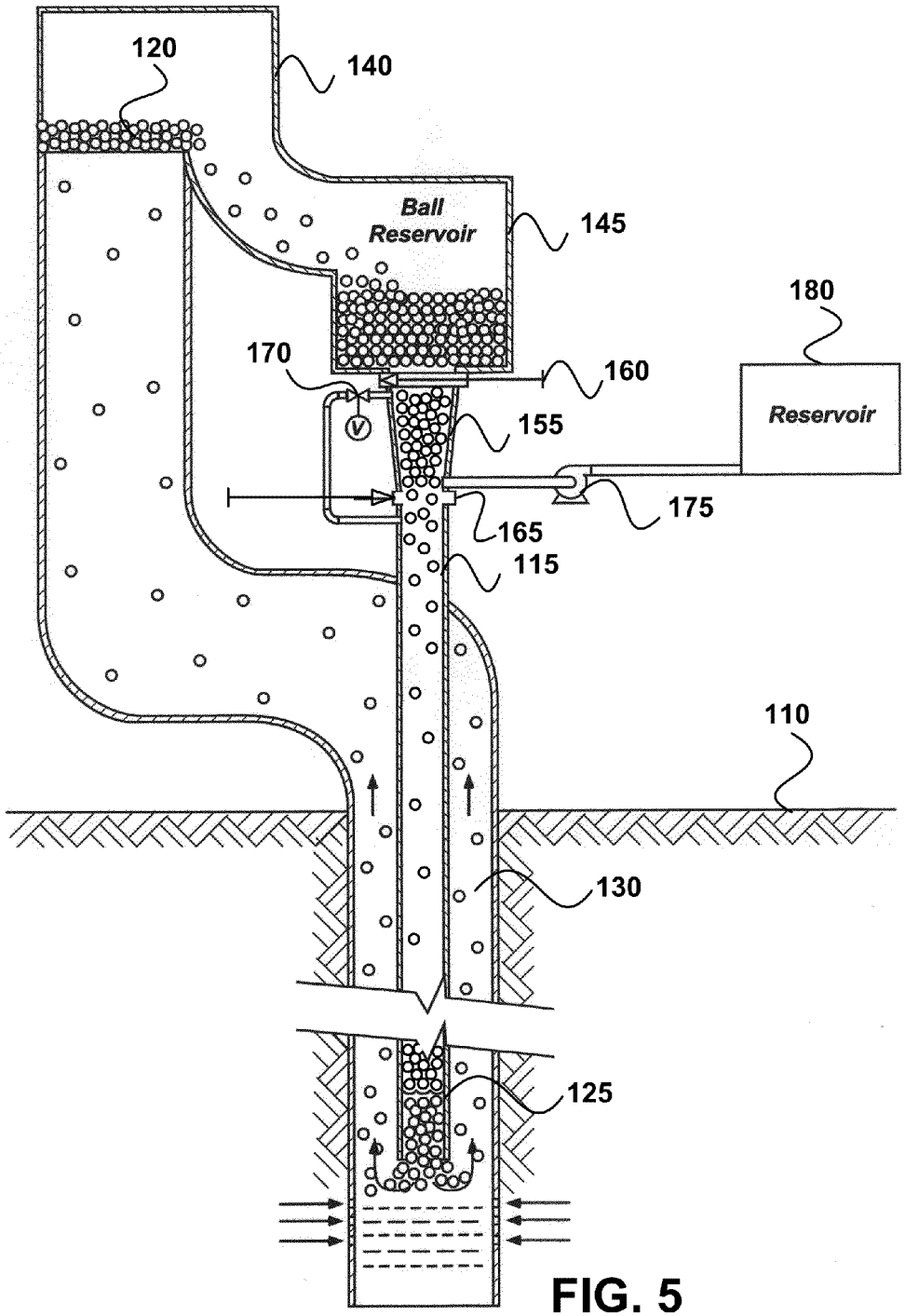
FIG. 5 is a cross sectional view of a buoyant ball recovery system where the balls enter the pipe string in accordance with an embodiment of the present disclosure.

FIG. 5 is a cross sectional view of a buoyant ball recovery system where the balls enter the pipe string in accordance with an embodiment of the present disclosure. Elements depicted are similar or the same as the elements depicted in FIG. 3. The upper valve 160 is closed separating the ball reservoir 145 from the hopper area 155. The pump 170 has been turned off and the vent valve 170 to the high pressure zone is open. The vent valve 170 vents to the high pressure zone while opened and allows the pressure to come to equilibrium in the hopper area 155 with the high pressure zone. At the end of this event, the lower slide valve 165 opens allowing the balls 120 to descend into the high pressure zone as gravity acts upon them. When the hopper 155 is emptied of its balls 120, the lower slide valve 165 closes again.

Figure 6:
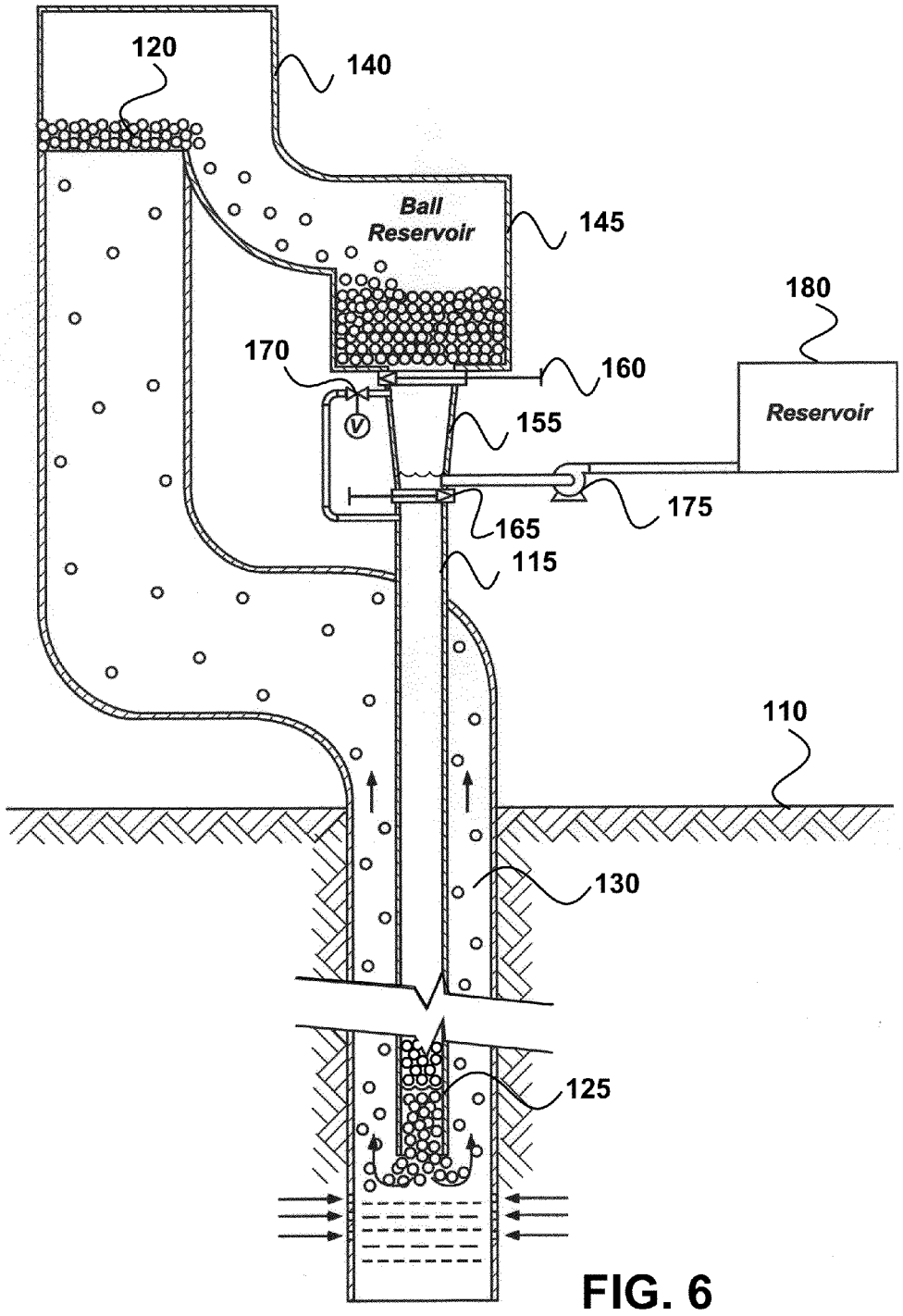
FIG. 6 is a cross sectional view of a buoyant ball recovery system where the hopper is filled with liquid in accordance with an embodiment of the present disclosure.

FIG. 6 is a cross sectional view of a buoyant ball recovery system where the hopper is filled with liquid in accordance with an embodiment of the present disclosure. Elements depicted are similar or the same as the elements depicted in FIG. 3. The lower slide valve 165 is closed. The upper slide valve 160 is closed and the vent valve 170 leading to the high pressure zone is left open. The pump 175 is turned on. The pump 170 is sufficiently powerful to overcome the pressure differential and proceeds to fill the hopper area again. Upon topping off the hopper area 155, the pump 175 turns off, the vent valve 170 to the high pressure zone is closed and the process repeats itself starting back at FIG. 3.

Figure 7:
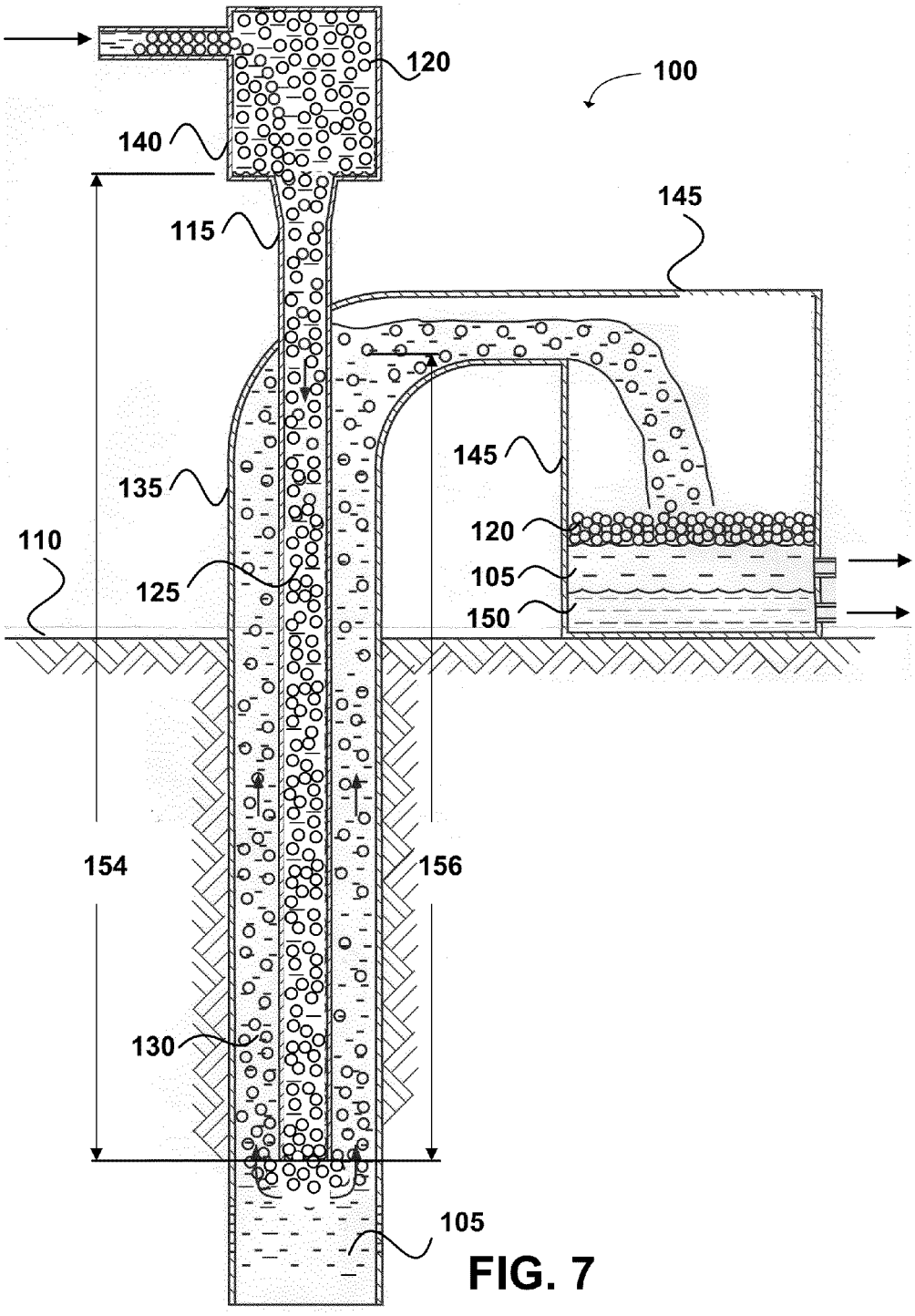
FIG. 7 is a cross sectional view of a buoyant ball assisted hydrocarbon lift system comprising an entrained column of buoyant balls in a fluid in accordance with an embodiment of the present disclosure.

FIG. 7 is a cross sectional view of a buoyant ball assisted hydrocarbon lift system comprising an entrained column of buoyant balls in a fluid in accordance with an embodiment of the present disclosure. The disclosed buoyant ball assisted hydrocarbon lift system 100 lifts a petroleum fluid 105 from an enclosed subterranean reservoir to the earth's surface 110. The disclosed system 100 includes a pipe string 115. The system also includes a plurality of buoyant balls 120 in the pipe string 115, the balls configured to at least one of displace a fluid mass 105 and a fluid mass 150 and have a surface friction moving in a fluid(s) therein. The column of buoyant balls is entrained in a fluid 150 in the pipe string, the entrained buoyant balls 120 are configured to enable a pressure differential in the annulus 130 with respect to the pressure in the reservoir and lift the entrainment via the annulus 130 to the earth's surface 110. The embodied system may also be configured to vice versa entrain the column of buoyant balls 120 in a fluid in the annulus 130, the entrained buoyant balls 120 are configured to enable a pressure differential in the pipe string 115 with respect to the pressure in the reservoir and lift the entrainment via the pipe string 115 to the earth's surface 110. The system 100 additionally includes a column 125 of the buoyant balls 120 in the pipe string 115, an aggregate weight of the balls 120 in the column 125 configured to entrain the balls 120 into a fluid 105 in an annulus 130 formed with an outer bore pipe 135. A ball reservoir 140 and a recovery reservoir 145 are also depicted. The ball reservoir 140 may be pressurized via a surface pump which may also pressurize the entrainment in the pipe string 115. Water 150 may be present in the reservoir and lifted into the recovery reservoir 145 via the disclosed system and method.

The buoyant balls 120 depicted in the ball reservoir 140 and in the pipe string 115 may be controlled on entry therein in order to uniformly entrain the balls in the first fluid 150. The first fluid may be a hydrocarbon mixture of water and production by-products according to recovery demands and recycling methods employed. The balls therefore may be throttled and may be dumped according to production schedules and flow rates required. The buoyant balls may therefore be introduced into the ball reservoir 140 entrained in the fluid 150 or the balls may be introduced separately into the ball reservoir 140 and entrained in the fluid 150 in the ball reservoir 140 under a pressure generated by a pump. In any case, the fluid 150 may fill any space between and around the buoyant balls in the column 125 such that an introduction of an additional buoyant ball at the top of the column may push and otherwise eject a buoyant ball at the bottom of the column 125 into the annulus 130. Likewise, an introduction of an additional buoyant ball 120 into the ball reservoir 140 when filled with entrainment comprising buoyant balls 120 and fluid(s) 150 may push and otherwise eject or release a buoyant ball 120 at the bottom of the column 125 into the annulus 130. The density of the buoyant balls depicted in the column 125 is not meant to limit the present disclosure which includes embodiments of higher density and lower density. Therefore, the density of the buoyant balls entrained in the first fluid 150 may be pre-determined by the petroleum production rate desired and the dynamics of the hydrocarbon reservoir being pumped and the efficiency of the mechanisms and methods disclosed herein. Also, the pressure that may be used to entrain the buoyant balls in the fluid 150 in the ball reservoir 140 may be predetermined. The entrainment trajectory depicted in recovery reservoir 145 is not intended to limit the claims of the present disclosure which may include pressures above and below the pressure depicted by the trajectory of the entrainment into the recovery reservoir 145.

An embodiment of a hydrocarbon lift system is disclosed herein for lifting petroleum fluid(s) 105 and 150 from an enclosed subterranean reservoir to the earth's surface 110, the system comprising a plurality of buoyant balls 120 entrained in a pipe string 115 in a first fluid 150, the balls 120 configured to at least one of displace a fluid mass and have a surface friction moving in the first fluid 150 therein. The system also includes an entrained column of the buoyant balls 120 in the pipe string 115, an aggregate weight of the balls 120 and the first fluid 150 configured to entrain the balls 120 into a second fluid 105 in an annulus 130 formed with an outer bore pipe 135. The system further includes a pressure differential in the annulus 130 with respect to the reservoir via the entrained buoyant balls 120, the pressure configured to lift the second fluid 105 and the entrained balls 120 to enhance petroleum production in the annulus 130 to the surface 110.

Another embodiment of the disclosed hydrocarbon lift system may further comprise a pump attached to the pipe string, the pump configured to pressurize the first fluid and the buoyant balls entrained therein from the pipe string. The column of buoyant balls entrained in the first fluid may be vice versa disposed in the annulus and the entrained buoyant balls in the second fluid may be vice versa disposed in the pipe string to enable a pressure differential in the pipe string to lift the buoyant balls and the second fluid to the earth's surface. The column of buoyant balls forms under an aggregate weight of the buoyant balls and the first fluid and extends from a bottom end of the pipe string to a column height greater than a height of the fluid in the pipe string and the annulus.

A further embodiment of the hydrocarbon lift system for lifting petroleum fluid(s) from an enclosed subterranean reservoir to the earth's surface, comprises a column of a plurality of buoyant balls in a pipe string configured to entrain the buoyant balls into a fluid in an annulus formed with an outer bore pipe. The disclosed system additionally includes a pressure differential in the annulus with respect to the reservoir via the entrained buoyant balls, the pressure differential configured to lift the fluid and the entrained balls in the annulus to the surface.

The column of buoyant balls may further comprise a density of to buoyant balls entrained in the first fluid predetermined by a specific gravity of the first fluid and a weight of each buoyant ball therein. Also, the column of buoyant balls may further comprise a density of buoyant balls entrained in the first fluid predetermined by an external pressure on the buoyant balls and the first fluid. Additionally, a second density of buoyant balls entrained in the second fluid may be based on the first density and on the specific gravity of the second fluid.

Therefore, the embodiments of the hydrocarbon lift system included herein comprise the surface friction of the buoyant balls moving through the fluid to create a loss of hydrostatic pressure in the annulus and create a lift of the fluid(s) at a lower pressure in the subterranean reservoir to the surface through the annulus.

A hydrocarbon lift system for lifting petroleum fluid(s) from an enclosed subterranean reservoir to the earth's surface is also comprised in an embodiment of the present disclosure. The system includes a plurality of buoyant balls configured in a column in a pipe string, the balls configured to at least one of displace a fluid mass and have a surface friction moving in a fluid. The system also includes a first pressure configured to entrain the buoyant balls in a first fluid in the pipe string and move the buoyant balls there through into a second fluid in an annulus formed with an outer bore pipe. The system additionally includes a pressure differential in the annulus created via a second pressure of the entrained buoyant balls in the second fluid with respect to a subterranean reservoir pressure, the pressure differential configured to lift the second fluid to the surface and enhance petroleum production in the annulus.

An embodiment of the hydrocarbon lift system is disclosed wherein the column of buoyant balls entrained in the first fluid is vice versa disposed in the annulus and the entrained buoyant balls in the second fluid is vice versa disposed in the pipe string to enable a pressure differential in the pipe string with respect to the subterranean pressure to lift the buoyant balls and the second fluid to the earth's surface.

Engineered spherical buoyant objects may be designed to optimize lifting forces and flow rates in accordance with an embodiment of the present disclosure. For example, a frontal area of a buoyant object may be substantially to flat. Also, cavities may be disposed on side surfaces or areas thereof, the cavities configured to capture a fluid and carry it to the surface for recovery. Additionally, wake forming ridges and/or fins may be employed to shape or detach a wake of a fluid around the buoyant object and also control an ascent pattern including zigzag, helical and any periodic ascent or rising patterns against the force of gravity. An engineered buoyant object, sphere or ball and other engineered shapes of a predetermined size and shape traveling at a given rise velocity may have a frontal effect on the liquid it is traveling upward through.

The accumulation of the liquid mass and the specific gravity of that liquid in a vertical column may be the sum of the weight of the column and/or the bottom psi. A buoyant object may travel faster or slower depending on the vertical height of the buoyant object. Considering a snapshot moment in time, focusing on the liquid just ahead of the rising object; this liquid may have its weight as it relates to the column weight altered to a lower value as it flows around the solid buoyant object rising upward through the column, thus changing the psi at the bottom of the column to some degree. The buoyant object's frontal push, as well as the tailing turbulence, may distort the bottom column's psi over and above the effects of the buoyant object's lighter mass (as compared to the liquid's specific gravity) in the column, thus affecting an effective buoyancy of the designer object.

An engineered placement of a large volume of buoyant objects in a liquid column may have a large effect on the bottom column's weight or psi as they ascend vertically through the column. The discharged flow rates may vary based on the size and shape of each buoyant object and the accumulated volume of the objects in relation to the liquid's volume they are rising through. Thus, an engineered designer shape may enhance or retard this effect also known as an effective buoyancy in an embodiment of the disclosure. The slower the buoyant object goes the less turbulence is generated on the trailing side. The faster the buoyant object goes the more turbulence is generated on the trailing side changing the effective weight of the buoyant object due to other forces acting on the buoyant object.

Therefore, a rise velocity of the buoyant balls may be based on a buoyant ball mass density in relation to the mass density of the fluids entraining to the buoyant balls. Where the mass density of the buoyant balls is less than the mass density of the entrainment, the buoyant balls may rise up through the entrainment. However, where the mass density of the buoyant balls is greater than the mass density of the entrainment, the buoyant balls may sink down through the entrainment. The quantitative relation of the mass density of the buoyant balls to the mass density of the entrainment may also determine the respective rise or sink velocity.

A variable diameter of a buoyant ball may also affect its variable rise velocity due to a viscous drag of the entrainment on the buoyant ball. The Reynolds' number is a dimensionless number used in fluid dynamics to indicate a ratio of inertial forces to viscous forces where inertial forces appear in the numerator and viscous forces appears in the denominator.

$$\mathrm{Re} = \frac{\rho v L}{\mu} = \frac{vL}{\nu}$$

The Reynolds' number Re is given by the hydraulic length L (variable diameter of the buoyant ball), v is the mean velocity of the buoyant ball relative to the fluid, μ is the dynamic viscosity (N s/m$^2$) of the fluid, ρ is the density of the fluid, and ν (denominator) is the kinematic viscosity of the fluid. The variable diameter may be varied by an operator of the well responsible for production. The diameter may be varied by either introducing buoyant balls of a different diameter or by increasing the diameter of the already present balls via mechanical and chemical means.

For a sphere in a fluid, the characteristic length-scale is the variable diameter of the sphere and the characteristic velocity is that of the sphere relative to the fluid some distance away from the sphere, such that the motion of the sphere does not disturb that reference parcel of fluid. The density and viscosity are those belonging to the fluid. Note that purely laminar flow only exists up to Re=0.1 under this definition and Stokes Law may apply. Stokes Law models the viscous flow around a sphere and gives the viscous force or drag on a sphere per unit area. The viscous force per unit area σ, exerted by the flow on the surface on the sphere, is in the z-direction everywhere. More strikingly, it has also the same value everywhere on the sphere.

The resulting terminal velocity (or settling velocity) may be given by:

$$v_s = \frac{2}{9}\frac{(\rho_p - \rho_f)}{\mu} g R^2$$

where R is the radius of the buoyant ball and $v_s$ is the particle's settling velocity (m/s) (vertically downwards if $\rho_p > \rho_f$, upwards if $\rho_p < \rho_f$), g is the gravitational acceleration (m/s$^2$), $\rho_p$ is the mass density of the particles (kg/m$^3$), and $\rho_f$ is the mass density of the fluid (kg/m$^3$) and μ is the dynamic viscosity (N s/m$^2$) of the fluid.

Therefore, the rise velocity of a buoyant ball may be predetermined and controlled in the second fluid in the inner pipe drill string by varying or controlling respective mass densities and the radius of the buoyant balls. A ratio of the mass density of the buoyant ball in a fluid less than one brings a rise velocity and a ratio of the mass density of a buoyant ball in a fluid greater than one brings a falling or sinking velocity relative to the entrainment fluid.

Also, a terminal velocity or a settling velocity of the buoyant balls in an entrainment may vary with the square of a radius of the buoyant balls. Therefore, larger buoyant balls may have much greater rise velocities assuming a mass density difference favoring the entrainment.

Furthermore, a rise velocity of the buoyant balls relative to a first or a second entraining fluid may be predetermined by a mass density of the buoyant balls relative to a mass density of the respective fluid. Additionally, a controlled rise velocity of the buoyant balls and therefore the second fluid also may be predetermined by a ratio of a mass density of the first fluid to a mass density of the second fluid greater than one, the mass density of the buoyant balls cancelling out in the ratio. Said another way, the rise velocity of the buoyant balls may be controlled via a ratio of the mass density of the second fluid to the mass density of the first fluid less than one.

Mathematically, for a positive rise velocity, $\rho_p<\rho_{f1}$ in fluid 1 and $\rho_p<\rho_{f2}$ in fluid 2 but fluid 1 is denser than fluid 2 since it contains water to a controlled amount. Therefore, the fluid 1 ratio is less than the fluid 2 ratio and therefore the following equations yields a number greater than one:

$$(\rho_p/\rho_{f2})/(\rho_p/\rho_{f1})$$

This allows a well operator to control the rise velocity of the buoyant balls by adjusting the buoyant ball density and diameter and by adjusting the mass density of the first fluid relative to the mass density of the second fluid via a water component and an oil component content. A mix of differing buoyant ball radii may be entrained in the first and second fluids to enable an average predetermined rise velocity there through. Ratios less than one may bring a slower rise velocity of the buoyant balls and ratios larger than one may bring a faster rise velocity to the surface.

When the mass density of the first fluid and the second fluid are approximately equal, then the rise velocity of the buoyant balls may be controlled via the diameter and therefore the mass density of the buoyant balls. The mass density of the first fluid is controlled at the surface by the well operators. The mass density of the second fluid may be determined by sampling or probing the well and may vary over time. Therefore the ratio of the two fluids may also be predetermined and controlled by the well operators to maximize buoyant ball rise velocity and production.

More specifically, a rise velocity between 22+ in/sec and 1.4 in/sec based on a buoyant ball specific gravity of 0.23 and a buoyant ball of about Ø¼" or smaller. A smaller particle size, having a Reynolds number of less than 1 may enable a rise velocity in oil of only 1.4 in/sec or less. In order to achieve 22 in/sec of rise velocity the buoyant ball may need to be almost 1 inch in diameter, variable from the quarter inch or smaller diameter. However, at this rise velocity it may no longer be strictly considered creeping flow (Reynolds number approximately 32) and the drag model may be adjusted slightly to better match this type of flow.

The production of petroleum from the subterranean reservoir to the earth's surface over time is therefore increased by an increase in the rise velocity of the buoyant balls which in turn produce a higher pressure differential in the lifting pipe with respect to the reservoir pressure. With an increase in rise velocity to comes an increase of oil flow per period of time. The disclosed method and system also enables flow from wells which have been furloughed for low pressure thereby increasing production in wells which have been previously abandoned.

A mechanical bit release may remotely release the core bit from the pipe string to allow oil production through the pipe string. The drill bit may be released before production starts because the internal diameter of the drill bit throat (2.312 in.) may not be large enough for production. Otherwise the bit is left in the hole. However, this metal "junks" the hole and may effectively prevents further coring. Removing or otherwise reducing the core bit in the inner pipe or pipe string enables production through the pipe string to the surface in an embodiment of the present disclosure.

Figure 8:
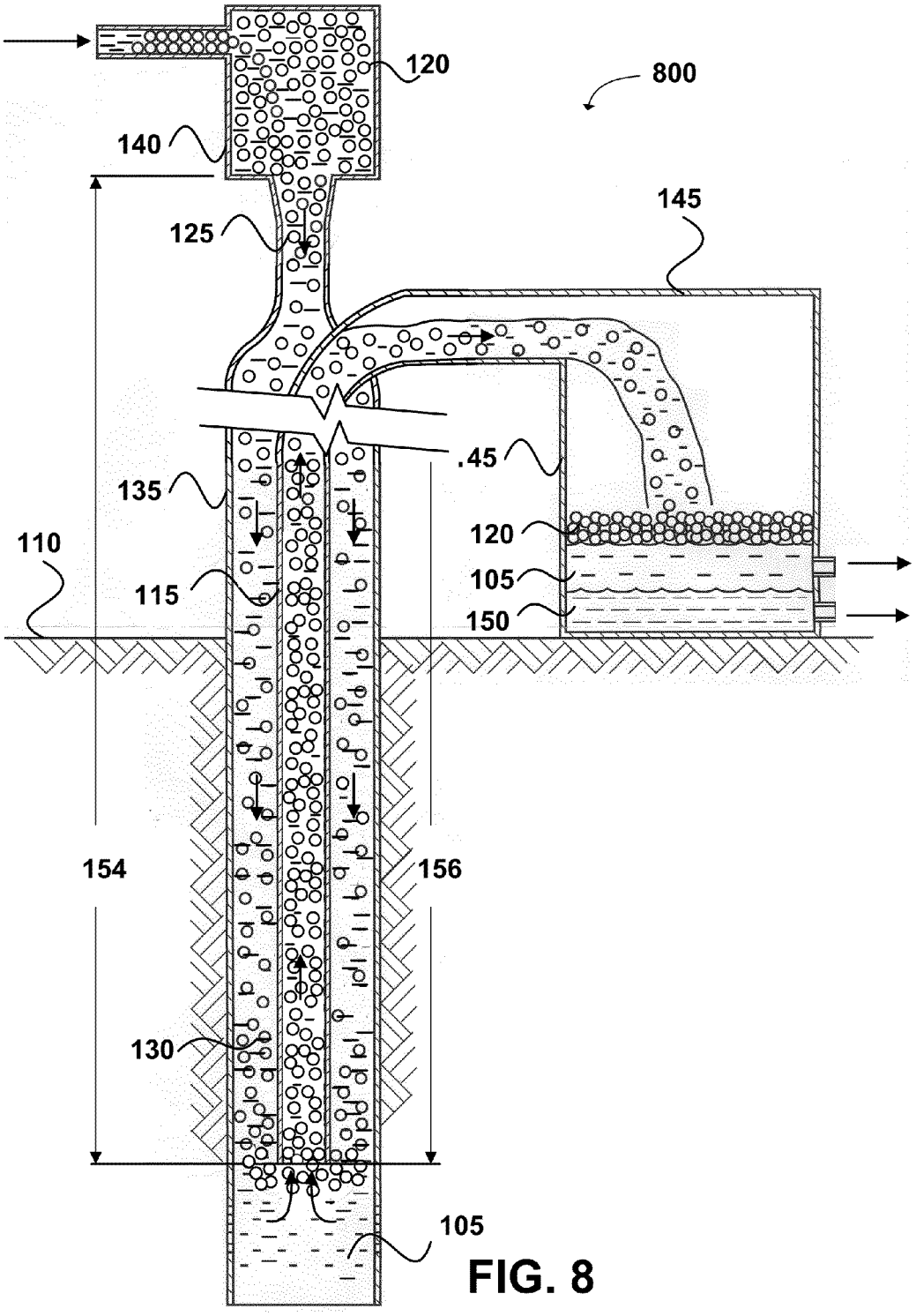
FIG. 8 is a cross sectional view of a controlled rise velocity buoyant ball assisted hydrocarbon lift system comprising an entrained column of buoyant balls in a fluid in accordance with an embodiment of the present disclosure.

FIG. 8 is a cross sectional view of a controlled rise velocity buoyant ball assisted hydrocarbon lift system comprising an entrained column of buoyant balls in a fluid in accordance with an embodiment of the present disclosure. The disclosed buoyant ball assisted hydrocarbon lift system 800 lifts a petroleum fluid 105 from an enclosed subterranean reservoir to the earth's surface 110. The disclosed system 800 includes a pipe string or inner pipe 115 and an outer pipe 135. The system 800 also includes a plurality of buoyant balls 120 in the pipe string 115, the balls configured to at least one of displace a fluid mass 105 and a fluid mass 150 and have a surface friction moving in a fluid(s) therein. The column of buoyant balls 125 is entrained in a fluid 150 in the outer pipe 135 or annulus 130, the entrained buoyant balls 120 are configured to enable a pressure differential in the pipe string or inner pipe 115 with respect to the pressure in the reservoir and lift the entrainment via the pipe string or inner pipe 115 to the earth's surface 110. The system 800 additionally includes a column 125 of the buoyant balls 120 in the annulus 130 or outer pipe 135, an aggregate weight of the balls 120 in the column 125 configured to entrain the balls 120 into a fluid 105 in an pipe string or inner pipe 115. A ball reservoir 140 and a recovery reservoir 145 are also depicted.

Returning to FIG. 8, the buoyant balls 120 depicted in the ball reservoir 140 and in the outer pipe 135 may be controlled on entry therein in order to uniformly entrain the balls in the first fluid 150. The first fluid 150 may be a hydrocarbon mixture of water and production by-products according to recovery demands and recycling methods employed. The second fluid 105 may be a petroleum fluid comprising oil and some hydrocarbon by-products according to the natural composition of the reservoir. The balls 120 therefore may be throttled and may be dumped according to production schedules and flow rates required via a predetermined and controlled rise velocity of the buoyant balls as disclosed herein. The buoyant balls 120 may therefore be introduced into the ball reservoir 140 entrained in the fluid 105 or the balls may be introduced separately into the ball reservoir 140 and entrained in the fluid 150 in the ball reservoir 140 under a pressure generated by a pump.

In any case, the fluid 105 or 150 may fill any space between and around the buoyant balls in the column 125 or in the annulus 130 such that an introduction of an additional buoyant ball at the top of the column may push and otherwise eject a buoyant ball at the bottom of the column 125 into the pipe string or inner pipe 115. Likewise, an introduction of an additional buoyant ball 120 into the ball reservoir 140 when filled with entrainment comprising buoyant balls 120 and fluid(s) 150 may push and otherwise eject or release a buoyant ball 120 at the bottom of the column 125 into the inner pipe or pipe string 115. A water content 150 of the first fluid separates therefrom and sinks at a bottom of the outer pipe based on a higher mass density than a petroleum content 105 thereof in combination with the petroleum in the reservoir and in the inner pipe drill string 115.

The density of the buoyant balls depicted in the column 125 is not meant to limit the present disclosure which includes embodiments of higher density and lower density. Therefore, the density of the buoyant balls entrained in the first fluid 150 and a subsequent rise velocity thereof may be pre-determined by the petroleum production rate desired and the dynamics of the hydrocarbon reservoir being pumped and the efficiency of the mechanisms and methods disclosed herein. Also, the pressure that may be used to entrain the buoyant balls in the fluid 150 may be predetermined. The entrainment trajectory depicted in recovery reservoir 145 is not intended to limit the claims of the present disclosure which may include pressures above and below the pressure depicted by the trajectory of the entrainment into the recovery reservoir 145.

An embodiment of the disclosed hydrocarbon lift system may further comprise a predetermined ratio greater than one of a mass density of the first fluid to a mass density of the second fluid. Also, an increase in petroleum production from the reservoir may be based on an increase in a controlled rise velocity of the buoyant balls and the second fluid via an increase in the ratio of the mass density of the first fluid to the mass density of the second fluid greater than one.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

While the forgoing examples are illustrative of the principles of the present disclosure in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the disclosure be limited, except as by the specification and claims set forth herein.

What is claimed is:

1. A hydrocarbon lift system for lifting petroleum fluid(s) from an enclosed subterranean reservoir to the earth's surface, the system comprising:

a) a plurality of buoyant balls entrained in a first fluid in an outer pipe, the balls configured to at least one of displace a fluid mass and have a surface friction moving in the first fluid therein;

b) an entrained column of the buoyant balls in the first fluid in the outer pipe, an aggregate weight thereof configured to entrain the balls and the first fluid into a second fluid in an inner pipe; and c) a pressure differential in the inner pipe with respect to the reservoir via the entrained buoyant balls, the pressure differential configured to lift the second fluid and the entrained balls via the inner pipe to enhance petroleum production to the surface.

2. The hydrocarbon lift system of claim 1, further comprising a pump attached to the outer pipe, the pump configured to pressurize the first fluid and the buoyant balls entrained therein through the outer pipe.

3. The hydrocarbon lift system of claim 1, wherein the column of buoyant balls entrained in the first fluid is vice versa disposed in the inner pipe and the entrained buoyant balls in the second fluid are vice versa disposed in the outer pipe to enable a pressure differential in the outer pipe to lift the buoyant balls and the second fluid to the earth's surface.

4. The hydrocarbon lift system of claim 1, wherein the column of buoyant balls forms under an aggregate weight of the buoyant balls and the first fluid and extends from a bottom end of the outer pipe to a column height greater than a height of the first fluid in the outer pipe.

5. The hydrocarbon lift system of claim 1, further comprising a controlled rise velocity of the buoyant balls relative to the first fluid predetermined by a specific gravity of each buoyant ball entrained in the first fluid and a variable diameter of each buoyant ball therein.

6. The hydrocarbon lift system of claim 1, wherein the column of buoyant balls further comprise a density of buoyant balls entrained in the first fluid predetermined by an external pressure on the buoyant balls and the first fluid.

7. The hydrocarbon lift system of claim 1, further comprising a controlled rise velocity of the buoyant balls relative to the second fluid, the rise velocity predetermined by a mass density of the buoyant balls relative to a mass density of the second fluid.

8. The hydrocarbon lift system of claim 1, further comprising a controlled rise velocity of the buoyant balls and the second fluid determined by a ratio of a mass density of the buoyant balls to a mass density of the second fluid greater than a mass density of the buoyant balls to a mass density of the first fluid.

9. A hydrocarbon lift system for lifting petroleum fluid(s) from an enclosed subterranean reservoir to the earth's surface, the system comprising:

a) a column of a plurality of buoyant balls in an outer pipe configured to entrain the buoyant balls into a first fluid in an annulus formed with an inner pipe drill string;

b) a pressure differential in the inner pipe drill string with respect to the reservoir via the entrained buoyant balls in a second fluid therein, the pressure differential configured to lift the second fluid and the entrained balls via the inner pipe drill string to enhance petroleum production to the surface;

c) a controlled rise velocity of the buoyant balls and the second fluid determined by a ratio of a mass density of the buoyant balls to a mass density of the second fluid greater than a mass density of the buoyant balls to a mass density of the first fluid; and d) an increased rise velocity of the buoyant balls and the second fluid to the surface via the inner pipe drill string based on an increase in a radius of each buoyant ball in relation to a smaller radius and a slower velocity of the buoyant balls in the first fluid.

10. The hydrocarbon lift system of claim 9, wherein a water content of the first fluid separates therefrom and sinks at a bottom of the outer pipe based on a higher mass density than a petroleum content thereof in combination with the petroleum in the reservoir and in the inner pipe drill string.

11. The hydrocarbon lift system of claim 9, wherein the mass density of the first fluid is comprised of a predetermined water and petroleum mixture and is higher in mass density than the mass density of the second fluid comprised of petroleum from the reservoir and petroleum separated from the first fluid wherein the buoyant balls have a controlled rise velocity within the second fluid in the inner pipe drill string.

12. The hydrocarbon lift system of claim 9, wherein a ratio of water to petroleum in the first fluid is greater than one and a ratio of water to petroleum in the second fluid is less than one to enable a positive rise velocity of the buoyant balls in the second fluid via a constant radius of the buoyant balls.

13. The hydrocarbon lift system of claim 9, further comprising a buoyant ball specific gravity of 0.23 plus or minus a 10 percent tolerance and an approximate 0.64 to 2.54 centimeters (0.25 inch to 1 inches) variable diameter for rise velocities between 3.56 cm/sec (1.4 in/sec) up to 56.0 cm/sec (22+ inches/second).

14. The hydrocarbon lift system of claim 9, wherein the surface friction of the buoyant balls comprises a predetermined radius moving through the second fluid and creates a loss of hydrostatic pressure in the inner pipe drill string and creates a lift of the fluid at a lower pressure in the subterranean reservoir to the surface through the inner pipe drill string.

15. A hydrocarbon lift system for lifting petroleum fluid(s) from an enclosed subterranean reservoir to the earth's surface, the system comprising:

a) a plurality of buoyant balls configured in a column in an outer pipe, the balls configured to at least one of displace a fluid mass and have a surface friction moving in a fluid;

b) a first pressure configured to entrain the buoyant balls in a first fluid in the outer pipe and move the buoyant balls there through into a second fluid in an inner pipe;

c) a pressure differential in the inner pipe drill string created via a second pressure of the entrained buoyant balls in the second fluid with respect to a subterranean reservoir pressure, the pressure differential configured to lift the second fluid to the surface and enhance petroleum production in the inner pipe drill string; and d) an increased rise velocity of the buoyant balls and the second fluid to the surface via the inner pipe drill string based on an increase in a radius of each buoyant ball in relation to a smaller radius and a slower velocity of the buoyant balls in the first fluid.

16. The hydrocarbon lift system of claim 15, wherein the column of buoyant balls entrained in the first fluid is vice versa disposed in the inner pipe drill string and the entrained buoyant balls in the second fluid are vice versa disposed in the outer pipe to enable a pressure differential in the outer pipe with respect to the subterranean pressure to lift the buoyant balls and the second fluid to the earth's surface.

17. The hydrocarbon lift system of claim 15, further comprising a predeterminable higher pressure differential in the inner pipe drill string based on a higher rise velocity of the buoyant balls relative to the second fluid predetermined by a specific gravity of each buoyant ball entrained in the second fluid and a predetermined diameter of each buoyant ball therein.

18. The hydrocarbon lift system of claim 15, further comprising a predetermined ratio greater than one of a mass density of the first fluid to a mass density of the second fluid.

19. The hydrocarbon lift system of claim 15, further comprising an increase in petroleum production from the reservoir based on an increase in a controlled rise velocity of the buoyant balls and the second fluid via an increase in the ratio of the mass density of the first fluid to the mass density of the second fluid greater than one.

* * * * *